US005172712A

United States Patent [19]

Robinson

[11] Patent Number: 5,172,712

[45] Date of Patent: Dec. 22, 1992

[54] SCREEN APPARATUS

[76] Inventor: Louie A. Robinson, 3065 Vista St., NE., Washington, D.C. 20018

[21] Appl. No.: 665,560

[22] Filed: Mar. 6, 1991

[51] Int. Cl.[5] ..... E04H 15/28

[52] U.S. Cl. ..... 135/98; 135/33.71; 135/33.41

[58] Field of Search ..... 135/98, 33.2, 20.1, 135/33.71, 33.41

[56] References Cited

U.S. PATENT DOCUMENTS

| | | | |
|---|---|---|---|
| 2,546,228 | 3/1951 | Martini | 135/33.2 |
| 2,943,634 | 7/1960 | Morgan | 135/98 |
| 3,419,024 | 12/1968 | Nickerson | 135/98 |
| 4,086,931 | 5/1978 | Hall | 135/20.1 |

FOREIGN PATENT DOCUMENTS

| | | | |
|---|---|---|---|
| 1424010 | 2/1976 | United Kingdom | 135/33.71 |

*Primary Examiner*—Henry E. Raduazo

[57] ABSTRACT

A combination beach umbrella and screen apparatus includes a flexible screen which is detachably affixed around the perimeter of the shade portion, or covering, of the umbrealla. The screen extends downward from the covering along the entire periphery thereof, thereby forming a screened in closure that may effectively be employed at the beach or other outdoor areas to provide shade, additionally, provide protection from annoying pestering insects, and adverse inclemental weather.

1 Claim, 3 Drawing Sheets

SCREEN APPARATUS

BACKGROUND OF THE INVENTION

1. Field of the Invention

This invention relates to a combination umbrella and screen attachment, and is more particularly directed to a novel type combination of a beach umbrella which has detachably attached thereto, when in use, an underlying screen apparatus.

2. Description of the Prior Art

The use of beach umbrellas for shading the sunlight while lying on the beach, and elsewhere, is conventionally well known in the art. In use, an open beach umbrella generally provides adequate protection from the sunlight to the user. However, other problems often are encountered by the user, while lying under the umbrella, which are not solved by the use of the umbrella. Typical problems encountered by the user, especially on the beach, or other outside areas, are pestering insects, wind, and other adverse inclemental conditions.

There have been many prior attempts to mitigate these problems, as much as possible. One attempt at preventing the above mentioned problems, that is, the annoyance of pestering insects, and mitigating the effect of inclemental adverse weather conditions is the employment of a screen device around the user. For example in the U.S. Pat. No. 4,599,754 to Mairs III, et al, there is disclosed a portable screen assembly for use in outdoor areas, serving as a barrier to the user from the sunlight and other inclemental conditions. Such a device partially accomplishes the objectives herein described. However, such a device, as disclosed by Mairs III, et al, cannot effectively be used in combination with a beach umbrella to adequately shade the sunlight, prevent pestering insects from annoying the user, and acts as a barrier against other inclemental weather conditions. Moreover, heretofore, there has been no practical umbrella and screen apparatus combination in use that would accomplish such objects.

SUMMARY OF THE INVENTION

It is a principal object of the present invention to provide a novel umbrella and attaching screen apparatus combination.

It is a further object of the present invention to provide a novel umbrella and screen apparatus combination, wherein, the screen is detachably affixed to the umbrella, and circumscribes the umbrella.

Still a further object of the present invention is to provide a novel umbrella and screen apparatus combination, which is portable to carry, and easily assembled and disassembled.

Other objects of the invention will become obvious to those skilled in the art upon reading the following application.

The above objects have been substantially achieved, as follows:

An umbrella, such as a conventional beach umbrella, when opened, and placed into position for use, has a screen, such as a single length mesh screen assembly, circumscribed about the outer periphery of the opened umbrella, the length of the screen extending from the umbrella to at least the surface in which the handle of the umbrella is affixed thereto. The lengthwise edges of the screen conveniently meet at a point on the umbrella. An elastic type cord is inserted through the top peripheral edge of the screen, and the screen is secured about the umbrella by fastening the cord at the top where the screen overlaps the umbrella, and the lengthwise edges coincide.

The screen may further be secured by mounting anchors to the bottom edge of the screen.

When securing the screen about the periphery of the umbrella, the screen may overlap the umbrella at any position, to adjust the screen to any desired length below the umbrella.

BRIEF DESCRIPTION OF THE DRAWING

The above invention will become apparent from the following detailed description, accompanied by the following drawing, in which.

DETAILED DESCRIPTION

Figure 1:
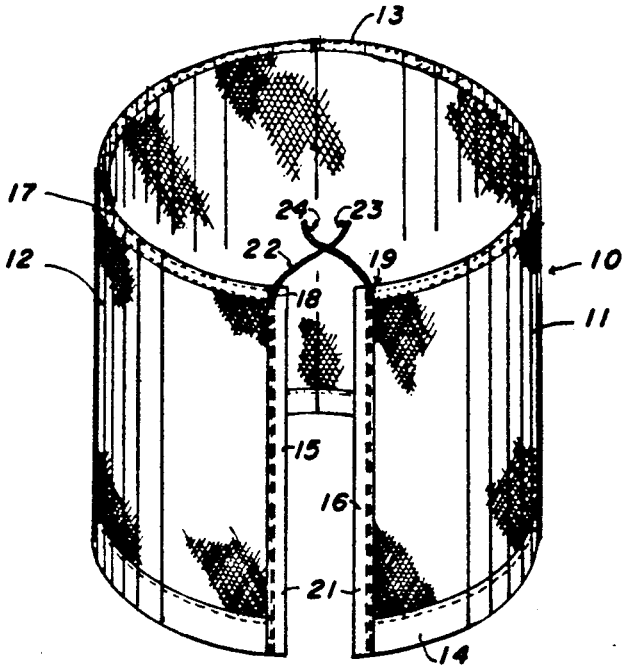
FIG. 1 is a prospective view of the screen assembly according to the present invention.

Referring to FIG. 1 a screen apparatus, designated as 10, includes a flexible screen 11. The screen 11 may be fabricated from a variety of known materials, including cloth, metal, and synthetic organic materials. As noted, the screen 11 is provided with a plurality of openings 12—12 essentially throughout, producing a conventional screen configuration. The screen apparatus 10 is a fixed length article having a top edge 13, a bottom edge 14 and corresponding side edges 15 and 16. A continuous passageway 17 extends through the screen 11, near the top edge 13 and parallel thereto, beginning from an first opening 18 near the edge 15, and ending at a second opening 19 near the edge 16. The edges 15 and 16 are desirably constructed of impervious material 21, to impart stability and strength to the screen 11. The material 21 is of the same class of materials as the screen 11. The passage way 17 is sufficiently large enough to receive a flexible cord 22 which extends therethrough from the opening 18 through the opening 19. The cord 22 is preferably an elastic material, such as cord known in the art as a "BUNGEE CORD". Cord 22, may also be made of other suitable materials, and has corresponding ends, 23 and 24.

Figure 2:
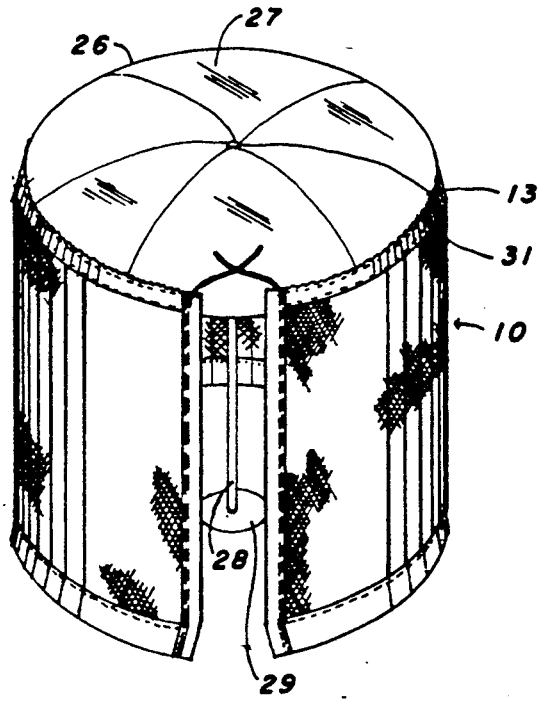
FIG. 2 is another prospective view of the screen assembly of FIG. 1, in a position to be attached to an umbrella.

In FIG. 2, therein is shown the screen apparatus 10 (FIG. 1) in position about the periphery of, and situated beneath an open umbrella 26. The umbrella 26 (FIG. 2) is conventional, and preferably is the well known beach umbrella, having the circular canvas covering 27. Extending from the covering 27 is an elongated handle 28, which when placed in situ 29, supports the covering 27 in an upright position.

Figure 3:
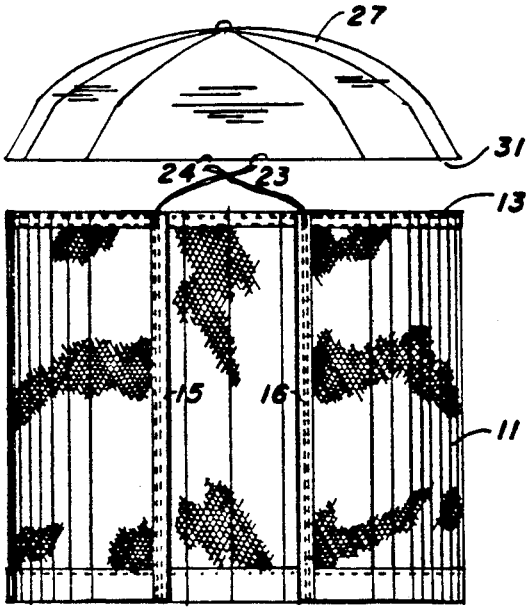
FIG. 3 is a planar view, similar to that of FIG. 2, illustrating the screen assembly in an open position for attachment to an overlying umbrella.
Figure 4:
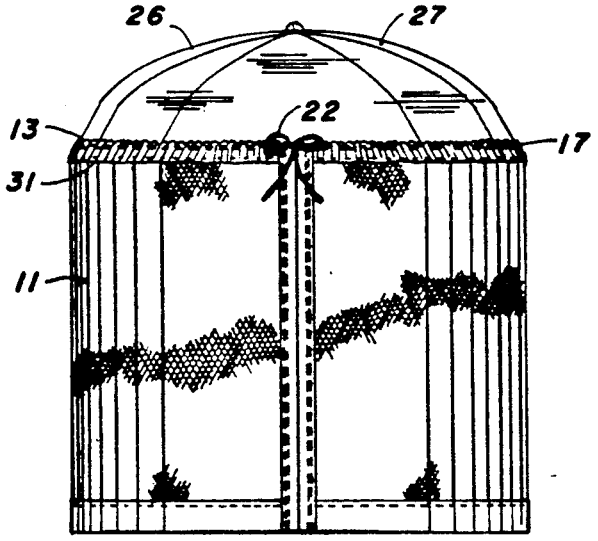
FIG. 4 is a planar view of the screen assembly after securing to an umbrella in the manner of the present invention.

Referring to FIGS. 2 and 3, the screen assembly 10 is positioned beneath the umbrella 26 so that the top edge 13 of the screen 11 is situated beneath the circumferential edge 31 (FIG. 2) of the covering 27. The screen assembly 10 is, thus, in a circular position about the covering 27, in the manner as best shown in FIG. 1 and FIG. 2. At this stage the edge 15 and the edge 16 are spaced apart so that the screen 11 is in an open position (FIG. 13). Next, the screen apparatus 10 is moved to a position so that the edge 13 of the screen 11 overlaps the edge 31 of the covering 27. The end 23 and the end 24 of the cord 22 are then pulled toward, and secured about each other, so that the edge 15 adn the edge 16 coincide to close the screen 11. (FIG. 4).

It is noted that although the edges 15 and 16 of the screen 11 coincide to close the screen 11, they are easily separated, from each other when it is desired to enter within the screened area, without removing the screen 11 from the covering 27. The cord 22, when tied in place, provides adequate security to prevent detachment of the screen 11 from the covering 27 of the umbrella 26.

Figure 5:
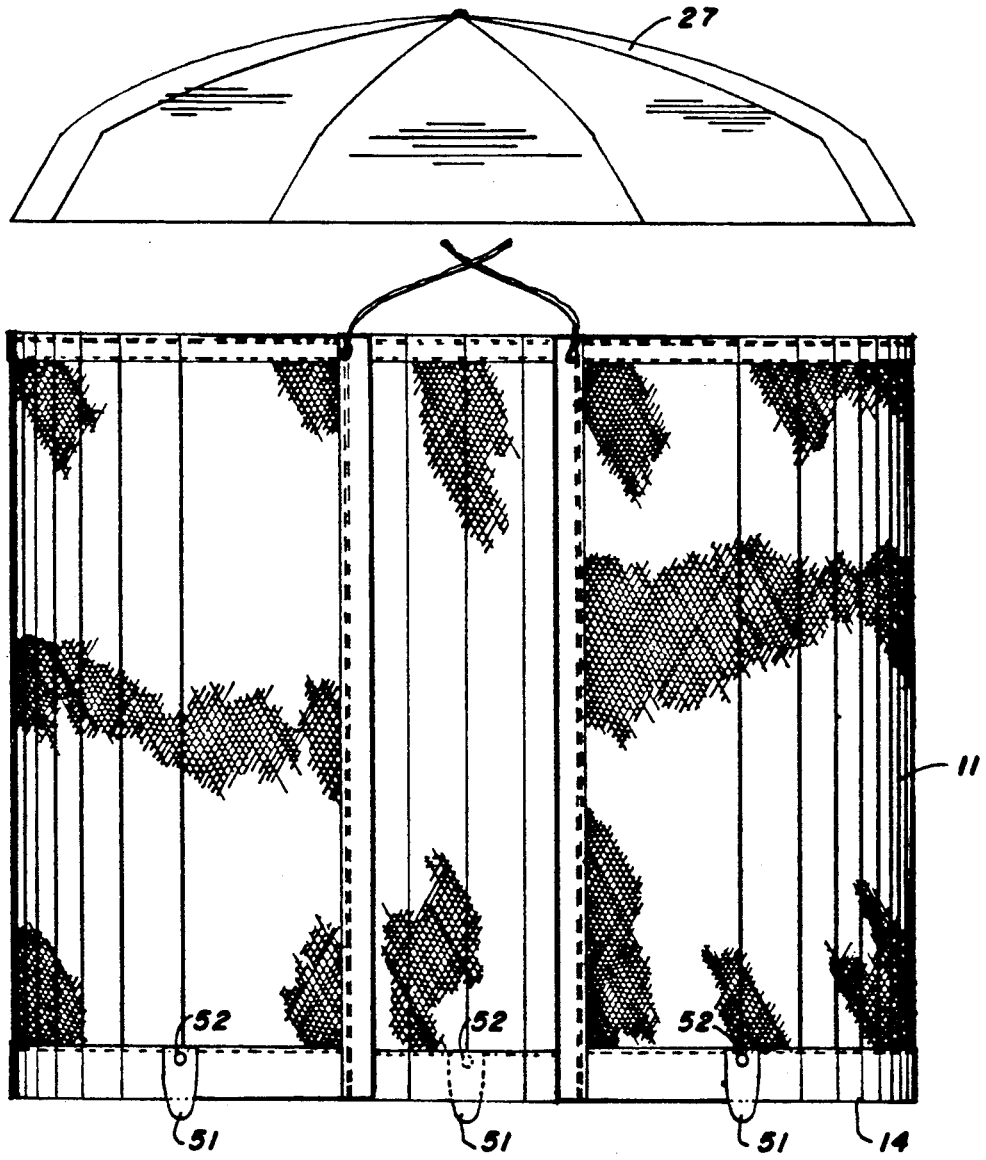
FIG. 5 is another planar view, similar to FIG. 2, illustrating a modified form of the present invention.

In FIG. 5, there is shown a modified structure designed to secure the screen 11 from unnecessary movement in the event forces, such as wind, and the like, occur. Attached about the periphery of the screen 11, near the bottom edge 14, are a plurality of floating anchors 51. The anchors 51 are mounted on the outside periphery of the screen 11 by suitably mounted screws 52 thereon. The screws 52 are easily removable from the screen 11 and the anchors 51, after use is completed. Moreover the anchors 51, when used, provided stability to the screen 11 near the bottom edge 14.

It is to be understood that certain obvious modifications can be made to the above assembly without departing from the scope and spirit of the invention. For example, other modes than disclosed herein can be employed to attach the screen apparatus 10 to the covering 27 of the umbrella 26. These mode include employment of zippers, and/or velcro fasteners as attachments, in lieu of the cord 22 attachment disclosed herein. Such modifications do not depart from the scope of the overall inventive concept. Moreover, it is to be understood that the edge 13 of the screen 11 can overlap the edge 31 of the covering 27 of the umbrella 26 at any desired level, depending upon the desired length of screen needed for use.

What is claimed is:

1. A screen device adapted to form an enclosure when secured to a conventional beach umbrella having a circular covering and an elongated handle which supports the covering at a fixed distance above a support surface such as a sandy beach, said screen device comprising: a rectangular piece of open screen material having an upper edge, a lower edge, two side edges, a length sufficient to circumvent said circular covering and a width sufficient to span the distance between said covering and said fixed surface, said upper edge having a means to secure said open screen material in overlapping relationship with said circular covering, said side edges being constructed to strips of impervious material secured to said open screen material to impart strength to the open screen material and to form an entrance to said enclosure when said device is secured to an umbrella, and a plurality of floating anchors selectively securable about the lower edge of said open screen material whereby said device may be secured to a conventional beach umbrella to form an enclosure and said floating weights may be secured as needed to hold said device in place above said support surface.

* * * * *